US006900593B2

(12) United States Patent
Imoto

(10) Patent No.: US 6,900,593 B2
(45) Date of Patent: May 31, 2005

(54) LIGHT SOURCE AND IMAGE READING DEVICE USING THE SAME

(75) Inventor: Yoshiya Imoto, Kanagawa (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 13 days.

(21) Appl. No.: 10/712,019

(22) Filed: Nov. 14, 2003

(65) Prior Publication Data

US 2005/0062429 A1 Mar. 24, 2005

(30) Foreign Application Priority Data

Sep. 9, 2003 (JP) ..... P2003-316523

(51) Int. Cl.[7] ..... H01J 13/46
(52) U.S. Cl. ..... 315/72; 315/219; 315/291
(58) Field of Search ..... 315/56, 72, 209 R, 315/219, 224–226, 276, 291, 307, 362

(56) References Cited

U.S. PATENT DOCUMENTS

| | | | | |
|---|---|---|---|---|
| 5,914,560 A | * | 6/1999 | Winsor | 313/493 |
| 6,191,539 B1 | * | 2/2001 | Green | 315/249 |
| 6,509,701 B1 | * | 1/2003 | Rakhimov et al. | 315/363 |

FOREIGN PATENT DOCUMENTS

| | | |
|---|---|---|
| JP | 5-144412 | 6/1993 |
| JP | 6-141145 | 5/1994 |
| JP | 2000-106146 | 4/2000 |
| JP | 2000-174984 | 6/2000 |
| JP | 2003-087507 | 3/2003 |

* cited by examiner

*Primary Examiner*—Thuy Vinh Tran
(74) *Attorney, Agent, or Firm*—Morgan, Lewis & Bockius LLP

(57) ABSTRACT

A light source of the invention includes: a cylinder having disposed therein a phosphor material that emits light by ultraviolet rays which are radiated due to discharge; a pair of internal electrodes disposed inside the cylinder; a pair of external electrodes a and b disposed outside the cylinder; and a lamp controller that switches between an external electrode lighting mode resulting from the application of a voltage to the pair of external electrodes and an internal electrode lighting mode resulting from the application of a voltage to the pair of internal electrodes, wherein the lamp controller controls, in the external electrode lighting mode, an electric potential $V_{IN}$ with respect to the pair of internal electrodes and an electric potential $V_H$ of the electrode of the higher electric potential of the pair of external electrodes to a condition where $V_{IN}>V_H$ or $V_{IN}\approx V_H$.

21 Claims, 5 Drawing Sheets

LIGHT SOURCE AND IMAGE READING DEVICE USING THE SAME

BACKGROUND OF THE INVENTION

1. Field of the Invention

The present invention relates to a light source that emits light whose spectral characteristics are different by switching between an external electrode lighting mode and an internal electrode lighting mode.

2. Description of the Related Art

Conventionally, technology has been proposed where invisible information is obtainable as an image signal by printing invisible information on a specific image—e.g., with a material that transmits visible light and absorbs infrared light—and reading, with an image sensor sensitive to infrared light, light reflected when infrared light is irradiated onto the image.

In applying the aforementioned technology to an image reading device, how to add, as a simple configuration, a configuration for invisible information reading to a configuration for ordinary image information reading has become a problem.

Until now, in order to read both visible information and invisible information, reading has been conducted by switching between a visible light reading mode and an infrared light reading mode by using a halogen lamp as the illumination light source, using the infrared light components that a halogen lamp inherently has and switching optical filters inserted on a midway optical path, as disclosed in JP-A-6-141145.

Incidentally, in recent years, it is becoming more and more common to use a noble gas fluorescent lamp instead of a halogen lamp as the light source for ordinary image information reading, with the purpose of reducing power consumption and improving reliability.

However, because noble gas fluorescent lamps include practically no infrared light in the components of the irradiation light thereof in ordinary lighting conditions, they cannot be used as they are for invisible information reading, it is necessary to add a separate light source such as an infrared LED, and a problem arises in terms of cost and disposed space.

With respect to this problem, the inventors of the present application have proposed intensifying the infrared light component included in spectral characteristics of the illumination light by switching the lighting modes of a noble gas fluorescent lamp, as described in JP-A-2000-174984.

As one example thereof, the inventors have proposed an image reading device that irradiates light onto a target and reads the light reflected therefrom, the device including: an airtight container having disposed therein phosphor materials that emit light by ultraviolet rays which are radiated due to discharge; a pair of internal electrodes disposed inside the airtight container; and a pair of external electrodes disposed outside the airtight container, wherein the amount of the infrared component is switched by switching between a mode that causes a discharge between the internal electrodes and a mode that causes a discharge between the external electrodes.

In the mode that causes a discharge between the external electrodes, the discharge is not concentrated at a specific place because the discharge path is formed from a dielectric material such as glass. Thus, an impulse discharge of an extremely short amount of time is ubiquitously generated.

As a result, ultraviolet light, which has a high energy, becomes the main component of the components of light emitted from xenon atoms of gas, and it becomes easy to excite the phosphors to emit visible components.

With respect thereto, in the mode where a discharge is caused between the internal electrodes, a dielectric material is not intervened on the discharge path, but a positive column is continuously joined between both electrodes. As a result, among the components of light emitted from the xenon atoms in the gas, the ratio of infrared light, which has a low energy, rises and the infrared component is directly emitted to the outside without exciting the phosphors. The present inventors actually made prototypes of lamps having these two electrodes and confirmed that the emitted light components are switched.

However, in the mode where the lamp is lighted by the external electrodes, the new problem arises that the internal electrodes sustain damage due to the discharge from the external electrodes.

As a countermeasure for a blackening phenomenon including this damage, in JP-A-5-144412, the blackening phenomenon is reduced by incorporating mercury in an internally sealed gas with respect to an internal electrode type. It has also been proposed to fill deuterium gas in a gas discharge display panel that has a structure similar to that of a noble gas fluorescent lamp.

However, when switching between the internal electrodes and the outer electrodes, the blackening phenomenon becomes worse than in the case of standard internal electrodes because the drive electric potential of the external electrode lighting mode that discharges through a dielectric material such as glass directly acts on the internal electrodes.

Also, as a light source having internal electrodes and external electrodes, there is a proposal for a structure in JP-A-2000-106146, but this is not a light source that switches between and lights two electrodes.

SUMMARY OF THE INVENTION

An object of the present invention is to solve the above problems. Namely, a light source of the invention includes: an airtight container having disposed therein a phosphor material that emits light by ultraviolet rays which are radiated due to discharge; a pair of internal electrodes disposed inside the airtight container; a pair of external electrodes disposed outside the airtight container; and a lamp controller that switches between an external electrode lighting mode resulting from the application of a voltage to the pair of external electrodes and an internal electrode lighting mode resulting from the application of a voltage to the pair of internal electrodes, wherein the lamp controller controls, in the external electrode lighting mode, an electric potential $V_{IN}$ with respect to the pair of internal electrodes and an electric potential $V_H$ of the electrode of the higher electric potential of the pair of external electrodes to a condition where $V_{IN}>V_H$ or $V_{IN}\approx V_H$.

In the invention, the electric potential of the pair of external electrodes does not greatly touch the plus side with respect to the electric potential of the pair of internal electrodes. Thus, with respect to the discharge generated between the external electrodes and the internal electrodes, the internal electrodes always serve as anodes and a cathode sputtering phenomenon in the internal electrodes that had been a source of damage does not occur.

According to the invention, there is the following effect. Namely, in a light source used to switch between a visible reading mode and an infrared reading mode, the blackening phenomenon accompanying the switching between the external electrodes and the internal electrodes is controlled, and it becomes possible to extend the life of the light source.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
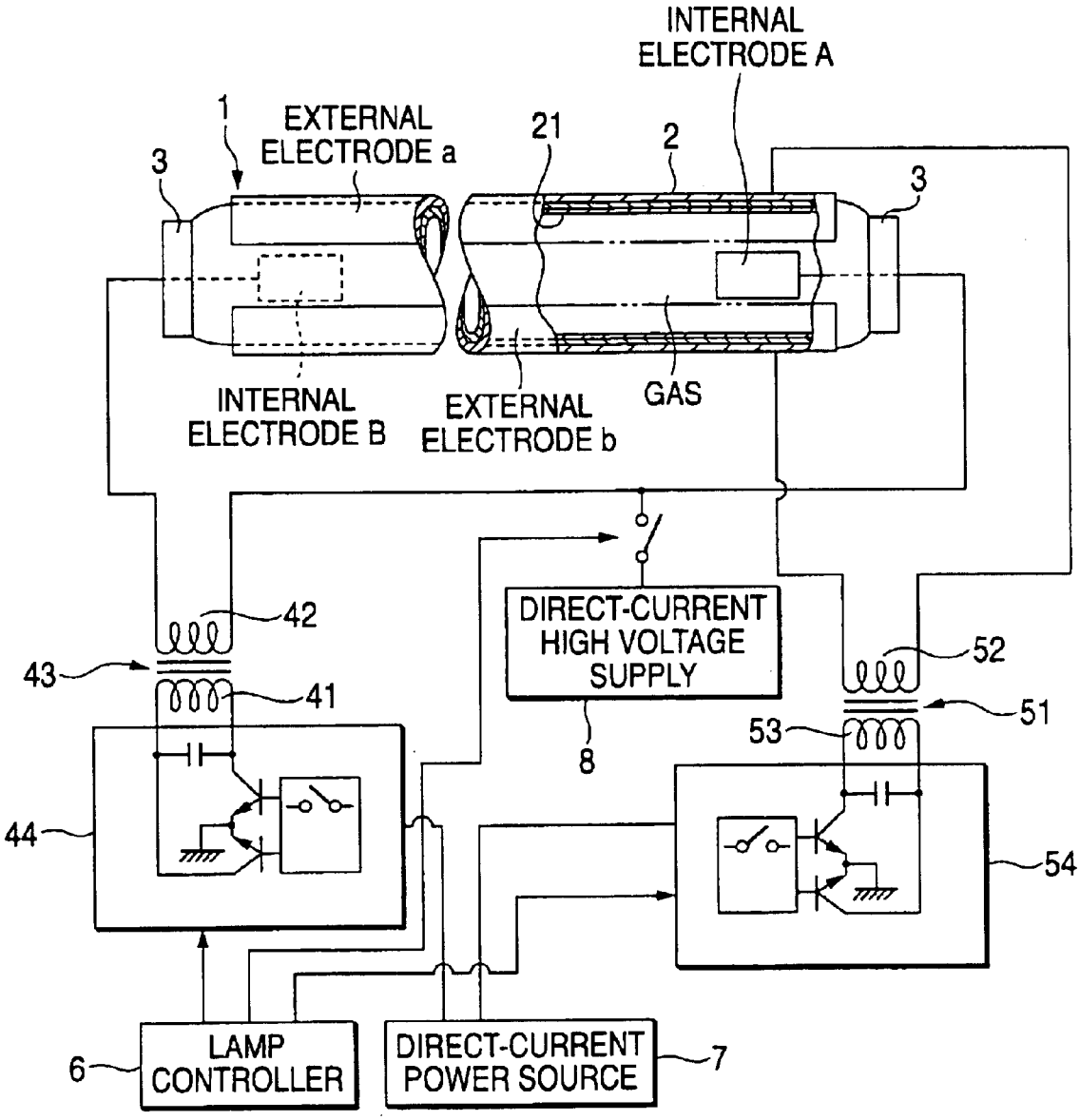
FIG. 1 is a schematic diagram describing a first embodiment.

Embodiments of the invention will be described below on the basis of the drawings. FIG. 1 is a diagram describing the structure of a light source pertaining to the present embodiment. That is, a light source 1 is disposed with a cylinder 2 including a transparent body, and specifically glass or quartz, that can transmit not only visible light but also infrared light; a pair of caps 3 that respectively seal, so as to be airtight, both end portions of the cylinder 2; and a pair of internal electrodes A and B that are respectively attached to the caps 3 and disposed inside the cylinder 2.

A noble gas, and preferably a gas including mainly xenon gas, is filled inside the cylinder 2. Phosphors 21 are disposed as a single layer on an inner surface of the cylinder 2. The phosphors 21 are coated so as to have an even thickness. However, in order to increase the amount of light emerging from the cylinder 2, there is a portion in a certain range of the inner surface of the cylinder 2 where the phosphors are not coated. This portion extends in a band along the axial direction of the cylinder 2. A reflective film may be disposed between the cylinder 2 and the phosphors 21 excluding the certain range.

Also, a pair of external electrodes a and b is disposed on an outer surface of the cylinder 2. The external electrodes a and b are fixed to the cylinder by, for example, vapor-depositing a conductive metal material thereon or adhering a foil-like metal thereto. The external electrodes a and b are disposed at mutually separate positions and respectively extend along the axial direction of the cylinder 2.

The external electrodes a and b are not disposed in the aforementioned range. Thus, the light of the light source 1 is emitted from a band-like opening portion. By applying a voltage to the internal electrodes A and B with this configuration, discharge is conducted between both. Also, by applying a voltage to the external electrodes a and b, discharge is conducted between both. As will be described later, the discharge between the mutual internal electrodes and the discharge between the mutual external electrodes are different in terms of their aspects.

The internal electrodes A and B are fed with electricity by an internal electrode-use feeder circuit (an internal electrode-use primary coil 41, an internal electrode-use secondary coil 42, an internal electrode-use transformer 43 and an internal electrode-use inverter circuit 44), and the external electrodes a and b are fed with electricity by an external electrode-use feeder circuit (an external electrode-use primary coil 51, an external electrode-use secondary coil 52, an external electrode-use transformer 53 and an external electrode-use inverter circuit 54). The feeder circuits convert direct currents from a direct-current power source 7 to alternating currents at the inverter circuits 44 and 54, feed the alternating currents to the primary coils 41 and 51 of the transformers 43 and 53, and boost the alternating currents at the secondary coils 42 and 52.

The inverter circuits 44 and 54 are configured by a switch, a transistor and a capacitor. A lighting order signal is supplied from a lamp controller 6 to the respective inverter circuits 44 and 54.

The internal switches of the inverter circuits 44 and 54 are switched ON by the lighting order signals, and the direct currents from the direct-current power source are converted to alternating currents. Thus, when the internal electrode-use inverter circuit 44 is switched ON, discharge is conducted between the internal electrodes A and B, and the light source 1 emits light in an internal electrode lighting mode.

Conversely, when the external electrode-use inverter circuit 54 is switched ON, discharge is conducted between the external electrodes a and b, and the light source 1 emits light in an external electrode lighting mode. When the lamp controller 6 does not supply the lighting order signal to either of the inverter circuits 44 or 54, electricity is not fed to either of the electrode pairs and the light source 1 does not emit light.

Figure 2:
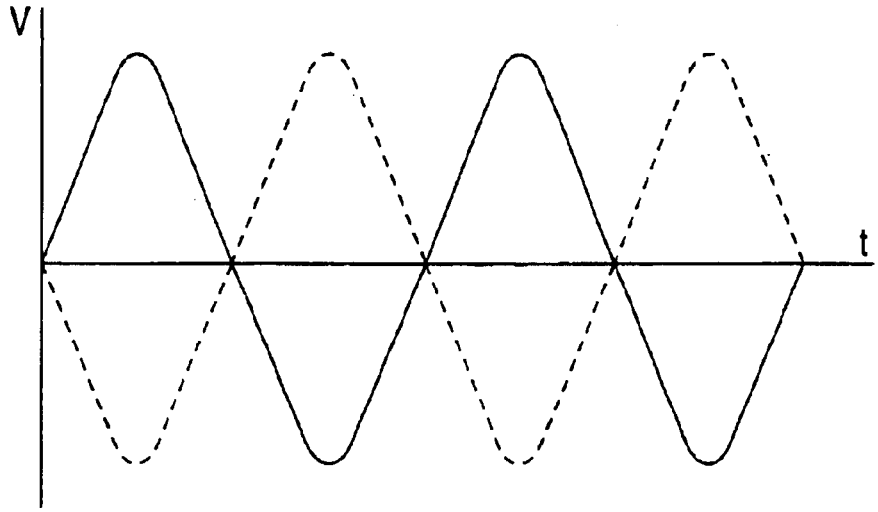
FIG. 2 is a diagram showing the waveform of a voltage applied to external electrodes.

Here, when light emission is conducted in the external electrode lighting mode, a discharge is generated between the internal electrodes, which are in an uncontrolled state. The waveforms of the voltages applied to the external electrodes are shown in FIG. 2. The electric potentials of the external electrodes a and b become mutually positive and negative high electric potentials, and an electric potential difference where the electric potential of the internal electrodes is lower arises between the external electrode of these whose electric potential is high and the internal electrodes.

Due to the discharge phenomenon generated at this time, a cathode sputtering phenomenon occurs where cations of the xenon in the internally filled gas are slammed against the internal electrodes, whose electric potential level is relatively low, due to the electric potential difference, whereby the electrode surface layers sustain damage, and substances knocked out from the electrodes adhere to the surrounding area and end up causing blackening.

As a countermeasure of the above, the present embodiment is disposed with a direct-current high voltage supply 8 shown in FIG. 1. That is, the line between the light source 1 and the direct-current high voltage supply 8 is short-circuited in the external electrode lighting mode by a control signal from the lamp controller 6, whereby an electric potential level $V_{IN}$ of the internal electrodes A and B is fixed at the electric potential level of the direct-current high voltage supply B. By fixing the relationship between $V_{IN}$ and a maximum $V_H$ of the voltage applied to the external electrodes so that $V_{IN}>V_H$ or $V_{IN}\approx V_H$, a large electric potential difference where the electric potential of the internal electrodes is lower does not arise between the internal electrodes and the external electrodes, and the cathode sputtering phenomenon also disappears.

Due to the discharge, the gas inside the cylinder is excited, light is emitted and the phosphors 21 are stimulated. Thus, the phosphors 21 generate light corresponding to the components of the phosphors 21. The phosphors 21 are excited to a resonance line of a wavelength of 147 nm or a resonance line of a wavelength of 147 nm and 172 nm of the light that the xenon atoms included in the gas emit, cause the phosphors that respectively emit blue (B), green (G) and red (R) light to emit light and generate visible light.

Figure 3:
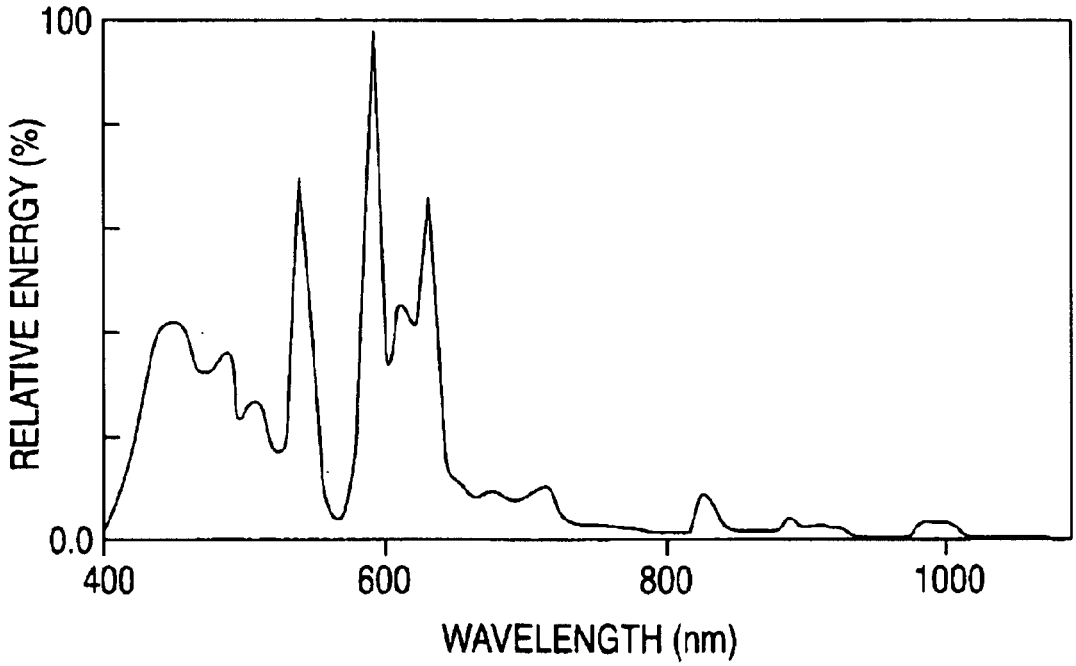
FIG. 3 is a diagram showing spectral characteristics when a light source is driven in an external electrode mode.
Figure 4:
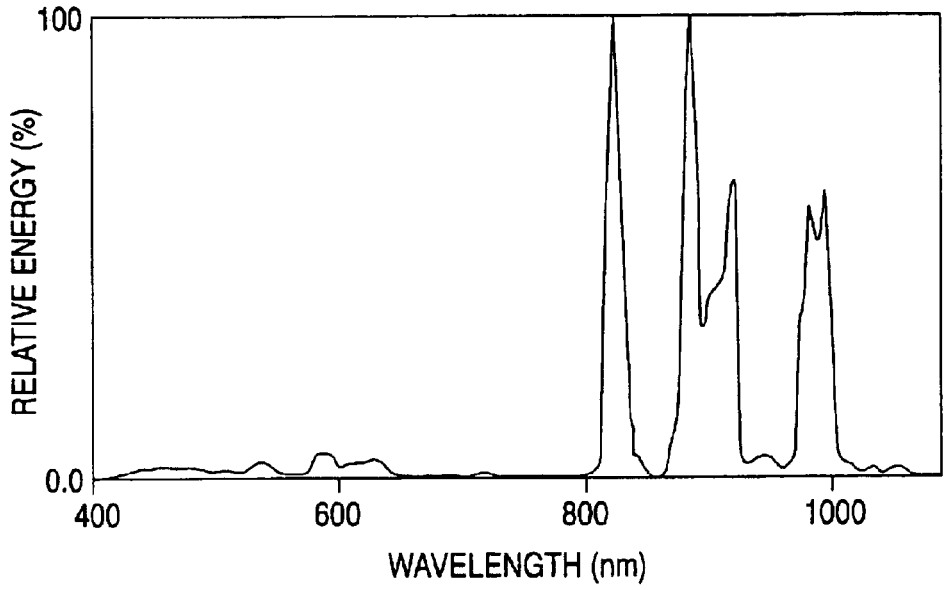
FIG. 4 is a diagram showing spectral characteristics when the light source is driven in an internal electrode mode.

Separate from this, the xenon atoms also emit infrared light. The ratio of the emissions of infrared light and ultraviolet light changes according to the discharge state of the gas. The spectral characteristics when the internal electrode lighting mode and the external electrode lighting mode are switched in this manner are shown in FIGS. 3 and 4. As stated in the "Prior Art" section, when the light source 1 is driven in the external electrode lighting mode, the ultraviolet light of the light emitted from the xenon atoms efficiently emitted and converted to visible light by the phosphors (see FIG. 3).

In the internal electrode lighting mode, the spectral characteristics shown in FIG. 4 can be obtained because the infrared light component of the components of light emitted from the xenon atoms is large, for the reasons stated in the "Prior Art" section.

Figure 5:
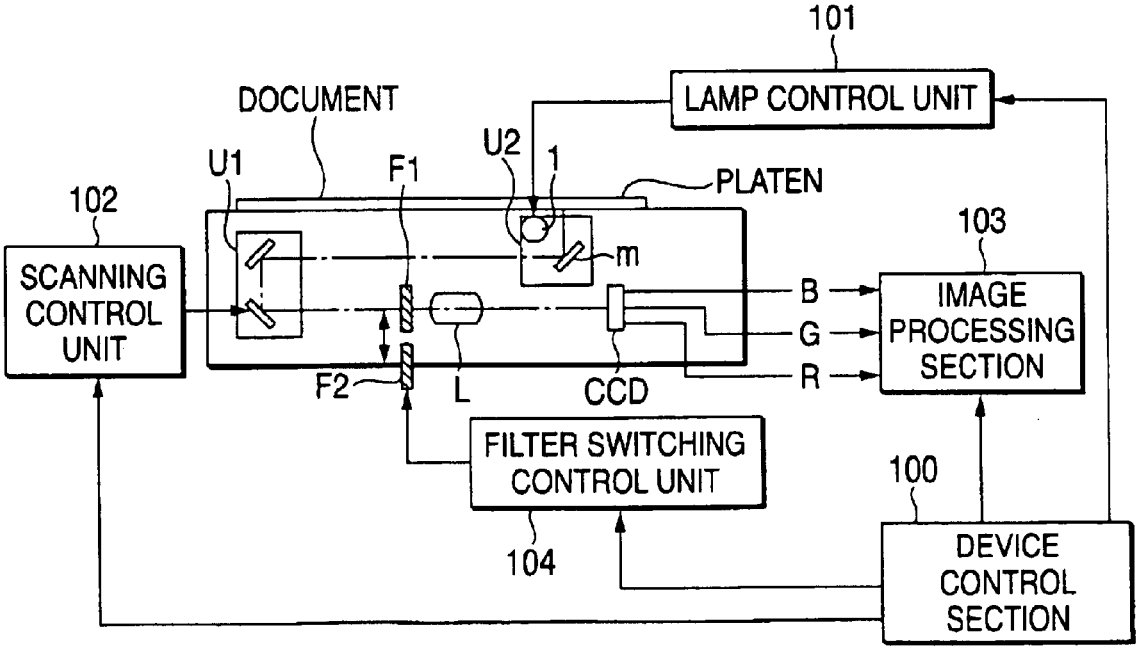
FIG. 5 is a block diagram of an entire image reading device.

An image reading device utilizing this characteristic change is described below. FIG. 5 is a block diagram of the entire image reading device. A reading document placed on a platen of the device is illuminated by the light source 1 mounted in a scanning unit U1, and the light reflected therefrom is guided to an imaging lens L by scanning mirrors of the scanning unit U1 and a scanning unit U2 and imaged in 3 line color image sensors (CCD). Due to this mechanism, the document information is successively scanned in the subscanning direction, whereby the image sensor is made to scan and expose the document to conduct reading.

Here, due to the action of a device control section 100 that controls the entire device, a lamp control unit 101 conducts lighting control of the light source 1, a scanning control unit 102 conducts movement control of the scanning units U1 and U2, an image processing section 103 conducts control of a processing circuit of a reading signal, and a filter switching control unit 104 conducts switching control of filters on an imaging light path.

In the lighting control of the light source 1 by the lamp control unit 101, switching of lighting/lighting extinguishment and visible light emission/infrared light emission is conducted. In the control of the scanning units U1 and U2 by the scanning control unit 102, control of the scanning reading position, scanning reading rate and scanning direction is conducted. The switching control of the filters by the filter switching control unit 104 is one that switches between a visible light transmitting and infrared cutting filter F1 and a visible light cutting and infrared light transmitting filter F2.

The two filters F1 and F2 placed in parallel in front of the lens are moved in a direction orthogonal to the lens optical axis (see the arrows in the drawing) and switched so that one of the two filter F1 and F2 is inserted in the imaging light path.

Figure 7:
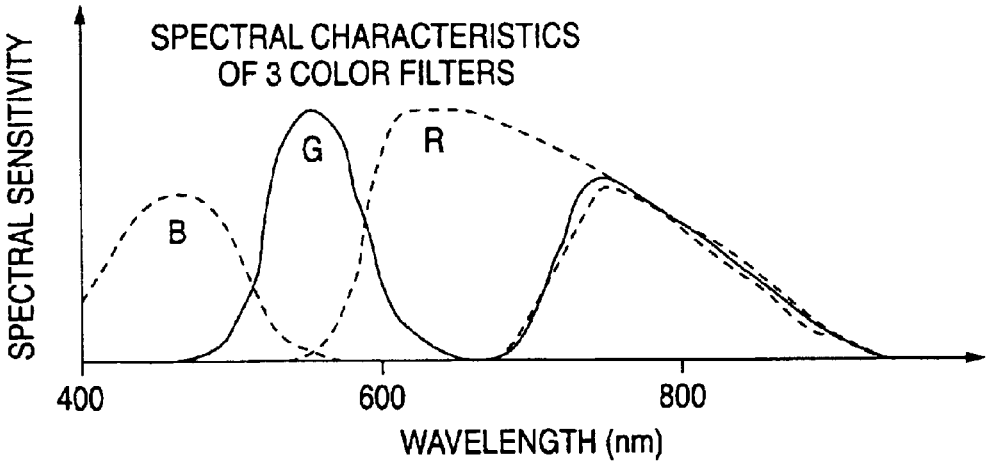
FIG. 7 is a diagram showing spectral sensitivity characteristics of CCD sensors.

Here, the 3 line color image sensors (CCD) used in the color image reading device are ones where color filters of the respective colors of R, G and B are formed on three reading pixels rows created on a single chip. The spectral sensitivity characteristics thereof are shown in FIG. 7.

As for the characteristics of these color filter, although they have transmittance characteristics of a wavelength band corresponding to each reading color in a visible light wavelength of 700 nm or lower, all of the colors have an unnecessary transmittance wavelength band in the near-infrared region of 700 nm or higher.

Figure 6:
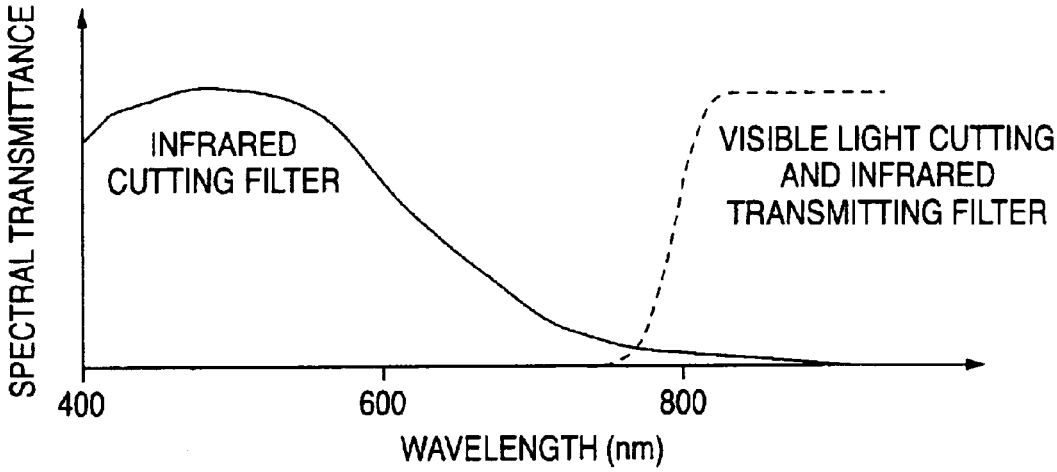
FIG. 6 is a diagram showing spectral characteristics of filters.

In ordinary reading, in order to cut the characteristic of the unnecessary transmittance region that ends up becoming noise information, the visible light transmitting and infrared cutting filter F1 shown in FIG. 6 is incorporated and reading is conducted.

Conversely, when infrared reading is conducted, the sensitivity of the unnecessary transmittance wavelength band of the color filter is used to advantage and the visible light cutting and infrared transmitting filter F2 shown in FIG. 6 is used, whereby reading of the infrared region is conducted.

As for the spectral response when the visible light cutting and infrared transmitting filter F2 is incorporated, although there are virtually no differences in the three channels of R, G and B, the output of the R channel, whose absorption from the red region of the color filter to the infrared is small, is used as an infrared reading signal.

Due to the above-described mode switching of the light source 1 and the switching of the filters F1 and F2, it becomes possible to conduct reading of high precision where the noise component is removed in both modes.

Figure 8:
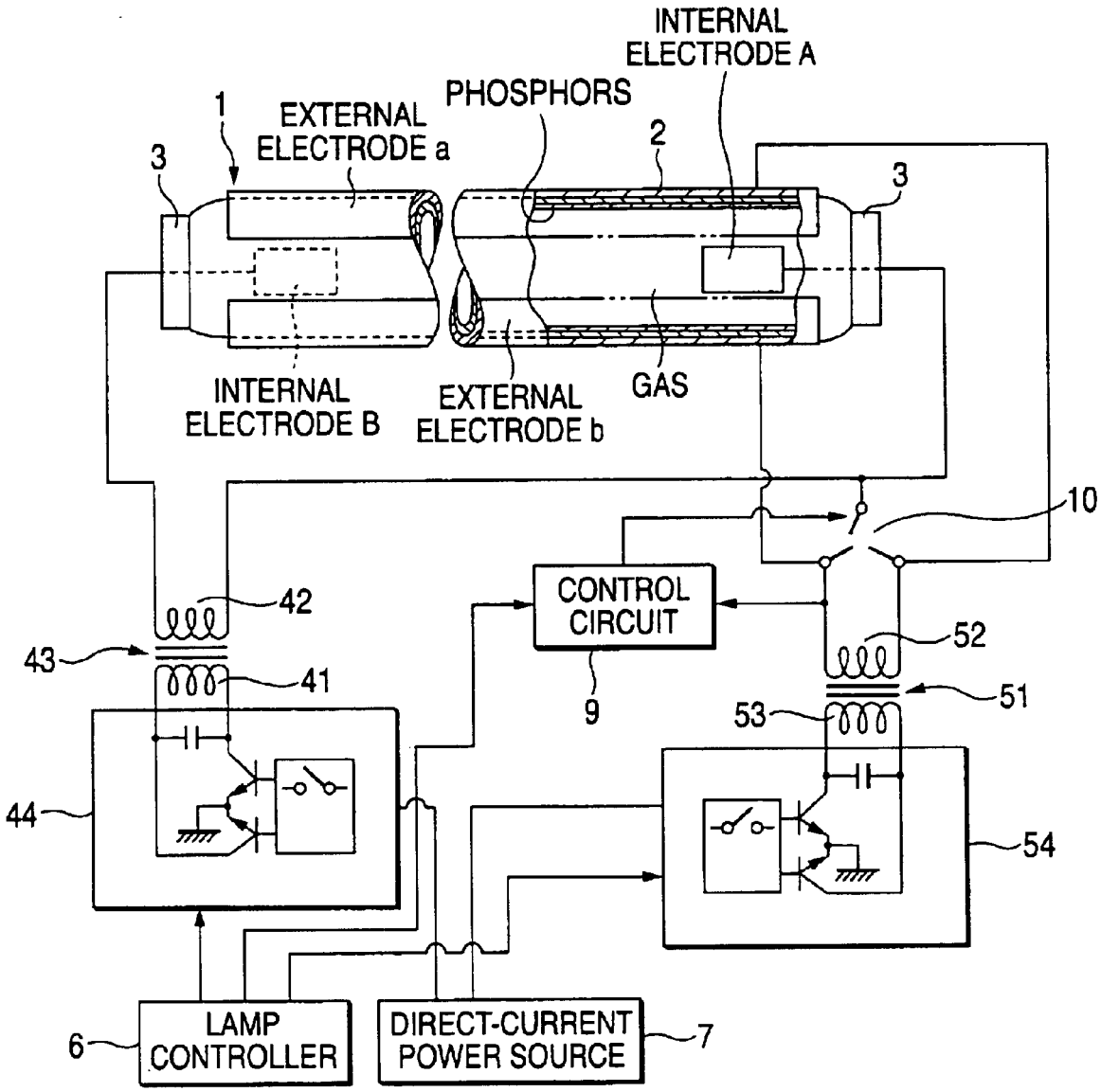
FIG. 8 is a schematic diagram describing a second embodiment.

Next, a second embodiment will be described. FIG. 8 is a schematic diagram describing the second embodiment. The light emitting system of the light source 1 pertaining to the second embodiment is characterized by means for controlling the application of voltage to the internal electrodes A and B in the external electrode lighting mode.

That is, although means where the internal electrode voltage in the external electrode lighting mode was such that $V_{IN}>V_H$ or $V_{IN}\approx V_H$ with respect to the electric potential $V_H$ of the external electrodes in the previously described first embodiment was realized by disposing the direct-current high voltage supply 8 (see FIG. 1), this is realized in the second embodiment by a control circuit 9 and a switching unit 10.

For example, the switching unit 10 is disposed between the external electrodes and the internal electrodes, and the electric potential of the internal electrodes A and B is controlled by the control circuit 10 so that it matches an electric potential that is the same as the electric potential of the electrode whose electric potential is the higher of the external electrodes a and b.

In other words, in the external electrode lighting mode, although voltages are applied to the external electrodes a and b with the waveforms shown in FIG. 2, a voltage is applied to the internal electrodes A and B so that it matches an electric potential that is the same as the electric potential of the electrode of the higher electric potential of this waveform.

Thus, the voltage $V_{IN}$ of the internal electrodes A and B in the external electrode lighting mode can be fixed so that so that $V_{IN}>V_H$ or $V_{IN}\approx V_H$, a large electric potential difference where the electric potential of the internal electrodes A and B is lower does not arise between the internal electrodes A and B and the external electrodes a and b, the cathode sputtering phenomenon is eliminated and the blackening phenomenon can be controlled.

Also, other means for matching the electric potential of the internal electrodes A and B to a potential so that it matches an electric potential that is the same as the electric potential of the electrode whose electric potential is the higher of the external electrodes a and b can be realized by disposing a rectifying unit of a high withstanding pressure.

What is claimed is:

1. A light source comprising:

an airtight container having disposed therein phosphor materials that emit light by ultraviolet rays which are radiated due to discharge;

a pair of internal electrodes disposed inside the airtight container;

a pair of external electrodes disposed outside the airtight container; and a lamp controller that switches between an external electrode lighting mode resulting from the application of a voltage to the pair of external electrodes and an internal electrode lighting mode resulting from the application of a voltage to the pair of internal electrodes; wherein the lamp controller controls, in the external electrode lighting mode, an electric potential $V_{IN}$ with respect to the pair of internal electrodes and an electric potential $V_H$ of the electrode of the higher electric potential of the pair of external electrodes to a condition where $V_{IN}>V_H$.

2. The light source according to claim 1, wherein the lamp controller fixes, in the external electrode lighting mode, the voltage of the pair of internal electrodes to a direct-current voltage value of a condition where the electric potential $V_{IN}$ with respect to the pair of internal electrodes and the electric potential $V_H$ of the electrode of the higher electric potential of the pair of external electrodes are such that $V_{IN}>V_H$ or $V_{IN}$ is substantially equal to $V_H$.

3. The light source according to claim 1, wherein a noble gas is filled inside the airtight container.

4. The light source according to claim 1, wherein a gas comprising mainly xenon gas is filled inside the airtight container.

5. The light source according to claim 1, wherein the light source emits visible light in the external electrode lighting mode and emits infrared light in the internal electrode lighting mode.

6. The light source according to claim 5, wherein the electric potential level $V_{IN}$ is fixed at an electric potential level of the direct-current high voltage supply, in the external electrode lighting mode.

7. The light source according to claim 1, further comprising:

a direct-current high voltage supply that generates a predetermined direct-current voltage applied to the pair of internal electrodes under the control of the lamp controller.

8. The light source according to claim 1, wherein the airtight container includes:

a cylinder that transmits not only visible light but also infrared light; and a pair of caps that respectively seal so as to be airtight both end portions of the cylinder.

9. The light source according to claim 8, wherein an inner surface of the cylinder includes:

a first portion that the phosphor materials are disposed as a single layer having an even thickness; and a second portion that the phosphor materials are not coated extending in a band along the axial direction of the cylinder.

10. The light source according to claim 9, wherein the cylinder further includes a reflective film that is disposed between the cylinder and the phosphor materials.

11. The light source according to claim 1, further comprising:

a switching unit that is disposed between the external electrodes and the internal electrodes; and a control circuit for controlling the electric potential of the internal electrodes so that the electric potential matches an electric potential that is the same as the electric potential of the electrode whose electric potential is the higher of the external electrodes, in the external electrode lighting mode.

12. The light source according to claim 1, further comprising:

a rectifying unit for controlling the electric potential of the internal electrodes so that the electric potential matches an electric potential that is the same as the electric potential of the electrode whose electric potential is the higher of the external electrodes, in the external electrode lighting mode.

13. The light source according to claim 1, further comprising:

an internal electrode-use feeder circuit for feeding the pair of internal electrodes;

an external electrode-use feeder circuit for feeding the pair of external electrodes; and a direct-current power source, wherein:

the internal electrode-use feeder circuit and the external electrode-use feeder circuit respectively includes an inverter circuit for converting direct currents from the direct-current power source to alternating currents; and a lighting order signal is supplied from the lamp controller to the respective inverter circuit.

14. A light source comprising:

an airtight container having disposed therein phosphor materials that emit light by ultraviolet rays which are radiated due to discharge;

a pair of internal electrodes disposed inside the airtight container;

a pair of external electrodes disposed outside the airtight container; and a lamp controller that switches between an external electrode lighting mode resulting from the application of a voltage to the pair of external electrodes and an internal electrode lighting mode resulting from the application of a voltage to the pair of internal electrodes; wherein the lamp controller controls, in the external electrode lighting mode, an electric potential $V_{IN}$ with respect to the pair of internal electrodes and an electric potential $V_H$ of the electrode of the higher electric potential of the pair of external electrodes to a condition where $V_{IN}$ is substantially equal to $V_H$.

15. An image reading device comprising:

a platen;

a light source that irradiates light onto a document image including:

an airtight container having disposed therein phosphor materials that emit light by ultraviolet rays which are radiated due to discharge;

a pair of internal electrodes disposed inside the airtight container; and a pair of external electrodes disposed outside the airtight container;

a lamp controller that switches between an external electrode lighting mode resulting from the application of a voltage to the pair of external electrodes and an internal electrode lighting mode resulting from the application of a voltage to the pair of internal electrodes; and an image sensor, wherein:

a reading document placed on the platen;

the lamp controller controls an electric potential $V_{IN}$ with respect to the pair of internal electrodes and an electric potential $V_H$ of the electrode of the higher electric potential of the pair of external electrodes to a condition where $V_{IN}>V_H$ or $V_{IN}$ is substantially equal to $V_H$, in the external electrode lighting mode; and the reading document is illuminated by the light source and a light reflected from the reading document is imaged in the image sensors.

16. The image reading device according to claim 15, wherein the lamp controller fixes, in the external electrode lighting mode, the voltage of the pair of internal electrodes to a direct-current voltage value of a condition where the electric potential $V_{IN}$ with respect to the pair of internal electrodes and the electric potential $V_H$ of the electrode of the higher electric potential of the pair of external electrodes are such that $V_{IN}>V_H$ or $V_{IN}$ is substantially equal to $V_H$.

17. The image reading device according to claim 15, further comprising:

a filter switching unit that switches filter restricting a spectral band of imaging light to an imaging light path in light reflected from the document image, to match the switching between the external electrode lighting mode and the internal electrode lighting mode.

18. The image reading device according to claim 15, wherein the light source emits visible light in the external electrode lighting mode and emits infrared light in the internal electrode lighting mode.

19. The image reading device according to claim 15, further comprising:

a direct-current high voltage supply that generates a predetermined direct-current voltage applied to the pair of internal electrodes under the control of the lamp controller.

20. The image reading device according to claim 15, further comprising:

a scanning unit including an imaging lens and a scanning mirror; and a scanning control unit for controlling a scanning reading position, scanning reading rate and scanning direction of the scanning unit; wherein the light reflected from the reading document is guided to the imaging lens by the scanning mirror, and imaged in the image sensor.

21. The image reading device according to claim 15, further comprising:

a visible light transmitting and infrared cutting filter;

a visible light cutting and infrared light transmitting filter; and a filter switching control unit for switching between the visible light transmitting and infrared cutting filter and the visible light cutting and infrared light transmitting filter, so that one of the two filters is inserted in the imaging light path.

* * * * *